United States Patent [19]

Seeberger

[11] 4,142,269

[45] Mar. 6, 1979

[54] CLEANING DEVICE

[75] Inventor: Rudolf Seeberger, Lochham, Fed. Rep. of Germany

[73] Assignee: Siemens Aktiengesellschaft, Berlin & Munich, Fed. Rep. of Germany

[21] Appl. No.: 847,845

[22] Filed: Nov. 2, 1977

[30] Foreign Application Priority Data

Feb. 16, 1977 [DE] Fed. Rep. of Germany ..... 2706599

[51] Int. Cl.[2] ..... G03G 21/00

[52] U.S. Cl. ..... 15/256.52; 15/301; 118/652

[58] Field of Search ..... 15/1.5, 256.51, 256.52, 15/256.53, 301, 308; 355/15; 118/652

[56] References Cited

U.S. PATENT DOCUMENTS

| | | | |
|---|---|---|---|
| 2,752,271 | 6/1956 | Walkup et al. | 355/15 X |
| 3,062,110 | 11/1962 | Shepardson et al. | 355/15 X |
| 3,410,060 | 11/1968 | Reilly et al. | 355/15 X |
| 3,483,679 | 12/1969 | Balbierer | 15/301 X |
| 3,570,244 | 3/1971 | Clemens | 355/15 X |
| 3,634,077 | 1/1972 | Sullivan | 355/15 X |
| 3,685,485 | 8/1972 | Kutsuwada et al. | 355/15 X |
| 3,687,730 | 8/1972 | Murphy et al. | 15/256.53 |

*Primary Examiner*—Edward L. Roberts

*Attorney, Agent, or Firm*—Hill, Gross, Simpson, Van Santen, Steadman, Chiara & Simpson

[57] ABSTRACT

A device for cleaning electrostatic copier drums. A rotary bristle brush is positioned axis parallel to the drum and contacts the drum surface. The brush is received in a shroud which includes a toner collection sub-chamber having an orifice exit to a suction system to return toner from the sub-chamber to the toner reservoir. The orifice is localized, providing a high volume air flow at the orifice opening. Oscillatory means act within the sub-chamber to insure that all toner within the sub-chamber is presented to the orifice.

20 Claims, 5 Drawing Figures

CLEANING DEVICE

BACKGROUND OF THE INVENTION

1. Field of the Invention

This invention relates to electrostatic copier devices and more particularly to a toner residue cleaning device for cleaning the intermediate carrier of such copiers.

2. Prior Art

The present invention is directed to a cleaning device for use in cleaning intermediate carriers of the kind which are used in electrostatic printers or copiers. Such cleaning devices are used to remove toner residues left behind on the intermediate carrier after completion of the sequential functions of charged latent image formation, image toner development and toner image transfer to a recording carrier. Such devices may contain a brush which wipes the toner residue from the intermediate carrier into a shroud surrounding the brush which shroud may be connected to a suction device.

Such cleaning devices for removal of toner residues from intermediate carriers in electrostatic copiers or printers are known. See for example U.S. Pat. No. 2,832,977. In electrostatic copiers of this type latent charge images of the character or image to be printed are produced electrographically or electrophotographically on an intermediate carrier such as a drum which is provided with a dielectric or photoelectric layer or surface. The charge images are thereafter developed at a developing station by the application of toner to the surface in a pattern determined by the latent image. Subsequently the toner image is transferred at a transfer station to a recording carrier, such as a paper sheet or web. After transfer, however, some toner residue may still remain on the intermediate carrier. Such residues must be removed before the intermediate carrier passes back again to the charging station inasmuch as residues remaining on the intermediate carrier surface will adversely affect subsequent image formation and printing.

It is well known to remove toner residues from the intermediate carrier by means of a bristled brush which is positioned such that the bristles wipe along the intermediate carrier's surface. Toner residues adhering to the brush are thereafter removed from the brush with the aid of a suction device.

To facilitate suction removal, the brush may be surrounded by a cowl or shroud which is, in turn, connected to the suction device. Cleaning of the brush can be further enhanced by providing a doctor strip or doctor blade adjacent the brush which helps to strip toner residues from the brush.

Preferably the brush has a length which corresponds to the length of the data carrier, normally a drum. Therefore the shroud is at least as long as the brush and, in order to assure that all toner residues are withdrawn from the cowl, the airflow by the suction device must be sufficiently large throughout the shroud so that the airflow at any given point is sufficient to extract the toner residue. When utilizing electrostatic printers which are capable of handling large paper widths, the corresponding drum, brush and shroud are thus considerably enlarged thereby requiring a very high performance suction device.

It would therefore be an advance in the art to provide for adequate toner removal from the shroud without the necessity of providing a high performance suction device.

SUMMARY OF THE INVENTION

It is thus a primary object of this invention to provide a cleaning device which is capable of removing toner residues from the brush shroud without the necessity of using a high performance suction device.

This object is achieved by modifying the shroud to provide a stripper chamber which is positioned such that toner residues whirled away from the brush will drop into the stripper chamber. The stripper chamber is then provided with at least one suction orifice connected to the suction device, the orifice being of a size such that toner residue within the sub-chamber will be sucked out of the sub-chamber by means of a locally developed air jet. In this manner, it is not necessary that the airflow be consistent throughout the area of the shroud in order to insure that all toner residue is picked up by the moving airstream.

In one embodiment herein illustrated, the stripper chamber can be provided with suction orifices at each of its ends. A pusher member is then positioned within the sub-chamber and is oscillated back and forth between the orifices. The pusher then pushes toner residue from the areas between the orifices to the orifices where the residue is then removed by the locally developed air jet. The pusher member can be conveniently connected to a cable which passes around two rollers one of which is motor driven.

In a second embodiment the shroud sub-chamber may be subdivided into two areas by a moving band which contains an orifice defining aperture. The band then can undergo an oscillating motion. In this construction the shroud is provided only with a single suction orifice to the suction device which may, for example be located in a central location. The moving band with its orifice aperture then operates in such a manner that the entire system is as if the suction orifice in the sub-chamber were itself performing an oscillating motion. The band can also be arranged to pass around to rollers, one of which is motor driven.

Oscillatory movement of the pusher or the moving orifice can be controlled by two switches which may, for example, be reed switches positioned adjacent the ends of the sub-chamber and which cooperate with an element carried by the cable or band which acts with the switches. The element can, for example, be a permanent magnet.

It is therefore an object of this invention to provide an improved cleaner device for removing toner residue from intermediate carriers electrostatic copiers.

It is another object of this invention to provide an improved cleaning device for removing toner residue from intermediate carriers in electrostatic copiers by means of a rotary bristled brush which discharges to a shroud, the shroud having a toner discharge receiving sub-chamber with an orifice opening to a suction device, the orifice opening being a limited area in comparison to the sub-chamber and oscillating means within the sub-chamber for insuring removal of toner through the orifice opening.

It is another, and specific object of this invention to provide a cleaning device for toner residue within electrostatic copiers including a rotary bristled brush which discharges to a shroud sub-chamber having two orifice openings therein spaced from one another with an oscillating pusher in the sub-chamber moving between the orifice openings.

It is another particular object of this invention to provide a device for cleaning intermediate carriers electrostatic copiers which includes a shrouded bristled rotary brush discharging to a toner receiving sub-chamber within the shroud, the sub-chamber having therein an oscillating band having an orifice therethrough, the band defining a wall portion of the sub-chamber with a suction applied to the shroud in a manner providing a localized airflow through the opening in the band.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 2:
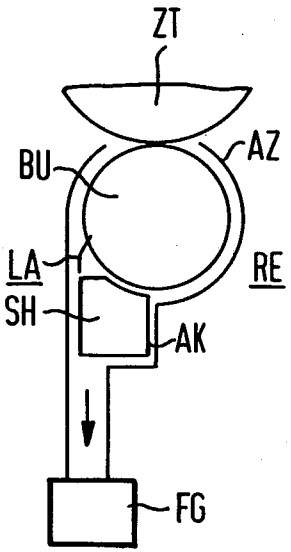
FIG. 2 is a schematic view of the cleaning system of FIG. 1 in side elevation.
Figure 1:
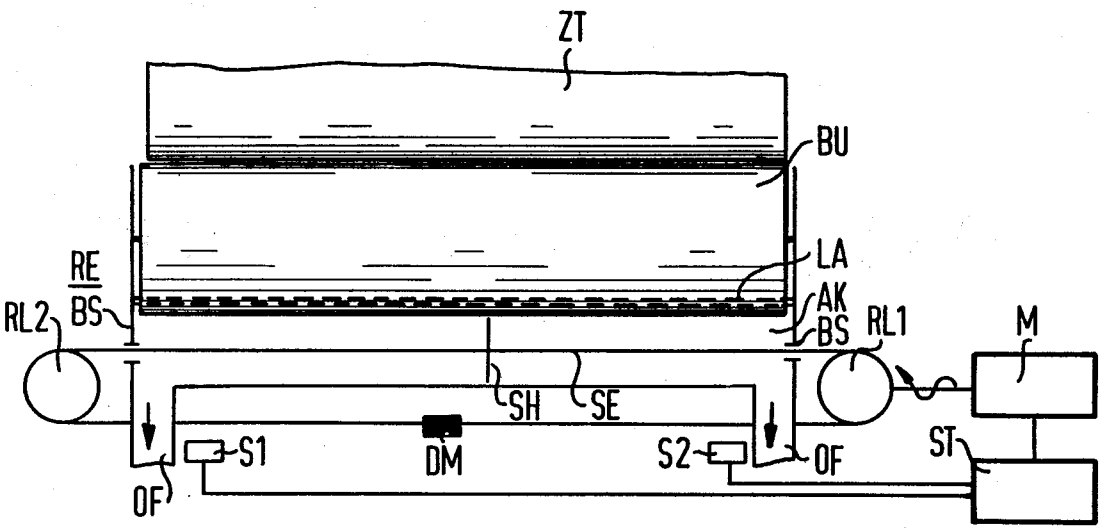
FIG. 1 is a schematic view of a cleaning system according to this invention.

A first embodiment of the cleaning device according to this invention is illustrated in FIGS. 1 and 2. Only a portion of the cleaning device and a part of the intermediate carrier ZT are illustrated. Reference is herein made to U.S. Pat. No. 3,634,007 for a more detailed explanation of electrostatic copiers of the type in which the present invention can be utilized. In FIG. 1, the intermediate carrier of the electrostatic copier may take the form of a drum ZT.

The cleaning device RE includes a rotary brush BU having bristles in contact with the image forming surface of the drum ZT. A shroud AZ is received around the brush BU. The shroud may be subdivided to provide a stripper chamber AK which has a pusher SH movable therein. A doctor strip or doctor blade LA is positioned within the shroud and engages the periphery of the brush and aids in ridding the brush BU of toner residue. The doctor blade is positioned such that the residue is whirled from the brush into the stripper chamber AK.

The shroud AZ has been extended to provide for a stripper chamber which may be formed separately within the shroud or as a configuration of the shroud. The stripper chamber extends over the full width of the shroud which in turn extends the full width of the brush BU.

Suction orifices OF are provided at each of the ends of the stripper chamber. The orifices OF are connected to a suction device FG which may be of known type. The suction device can, for example, be a blower. Toner residue from within the sub-chamber AK can be removed via the suction orifices OF.

The slider, or pusher, SH has a configuration which corresponds to the cross section of the stripper chamber AK and is attached to a cable SE. The cable has a first reach within the stripper chamber AK which exits therefrom at each end BS of the shroud. Rollers RL1 and RL2 are positioned exterior of the stripper chamber and the cable SH moves over the rollers. A second reach of the cable is positioned exterior of the stripper chamber AK. One roll, in the illustrated embodiment RL1, is driven by a motor M.

The motor M is controlled through control circuit ST in such a manner that the cable SE moves the pusher SH in an oscillatory manner from adjacent one end of the sub-chamber AK to adjacent the other end of the sub-chamber AK and back again. In so doing, the pusher SH will remove any toner residues collected between the orifices OF to the orifices OF where the residue will be sucked out of the sub-chamber by a local intensified airflow at the orifices. Because the orifices have an opening area which is considerably less than the shroud dimension, the airflow will be greater at the orifice opening than elsewhere throughout the shroud, and particularly will be greater at the orifice opening than in the intermediate area between orifice openings. Because the pusher SH moves toner to the orifices, it is not necessary for the airflow within the sub-chamber to be great enough to, by itself, withdraw toner material from the intermediate reaches of the sub-chamber.

In order to produce the oscillatory movement of the pusher SH, a permanent magnet DM may be affixed to the reach of the cable SE exterior of the sub-chamber AK. Switches S1 and S2, which may may for example, be reed switches, may be positioned adjacent the suction orifices OF of otherwise adjacent the ends of the sub-chamber. When the permanent magnet DM passes either the switches S1 or S2, the switch will be activated. Activation of the switches S1 and S2 supply corresponding signals to the control circuit ST which cause reversal of the rotation of the reversible motor M.

The device functions as a cleaner as follows: The brush BU strips toner residue from the intermediate carrier ZT in known fashion. The toner residue which adhere to the brush BU are removed from it with the aid of the doctor blade LA and whirled into the sub-chamber AK. In the sub-chamber AK, the pusher SH oscillates back and forth pushing the toner residues collecting between the suction orifices OF to the orifices. The toner residue is then sucked out of the sub-chamber AK by an air jet formed by the locally intensified airflow at the orifices.

Figure 4:
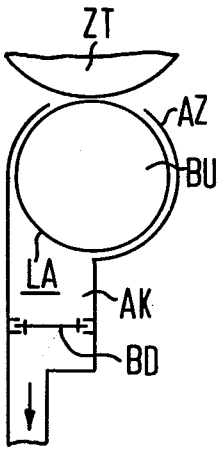
FIG. 4 is a view similar to FIG. 2 illustrating the modified form of FIG. 3.
Figure 3:
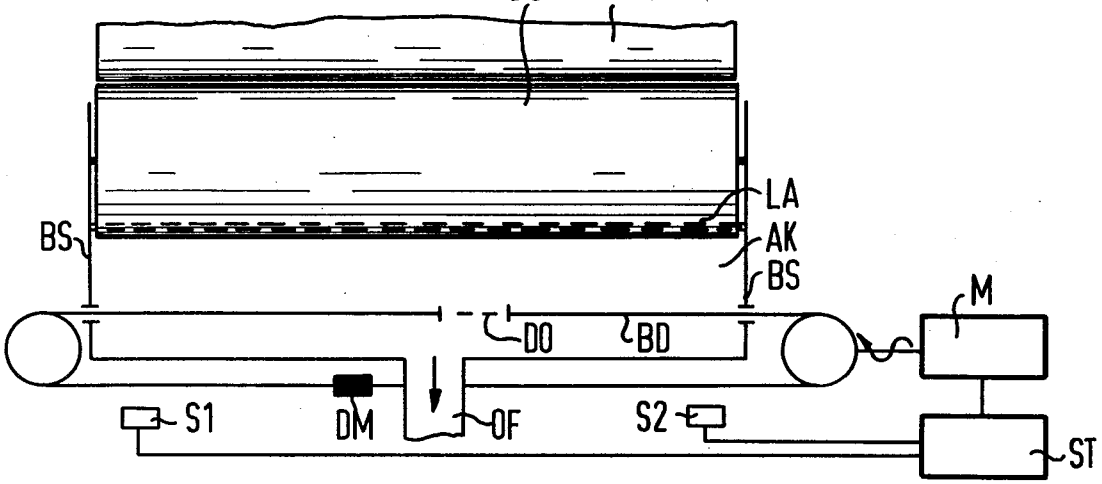
FIG. 3 is a view similar to FIG. 1 illustrating a modified form of the invention.

A modification of the cleaning device of FIGS. 1 and 2 is illustrated in FIGS. 3 and 4. The device corresponds to a large extent to that of FIG. 1 and includes a rotary bristled brush BU, a doctor strip LA and a shroud AZ. Once again the shroud is modified to provide a stripper sub-chamber AK adjacent the brush for receipt of toner residue from the brush. The sub-chamber is defined by a large area extension of the shroud AZ. A band or belt BD bisects the shroud in the area of the shroud extension in such a manner that a first toner receiving chamber is formed above the band and a suction chamber is formed below the band. The band passes through the sub-chamber and exits the shroud through apertures in the end sides BS of the sub-chamber AK. The band, as illustrated in FIG. 4, extends for the cross-section of the chamber AK forming a wall within the sub-chamber. The band BD, as is in the case of the cable SE passes between rollers RL1 and RL2 located outside of the chamber with one of the rollers connected to a motor M.

In the span of the band BD, within the sub-chamber AK, an orifice DO is provided. Additionally in the sub-chamber AK below the band, a single suction orifice OF is provided located substantially in the center of the sub-chamber. The orifice OF is connected to a suction device.

The motor M is controlled by control circuit ST in such a manner that the orifice DO and the band BD oscillate back and forth in the chamber AK. Consequently, the zone of the chamber AK from which toner residue is being sucked away at any given instant via the orifice DO and the suction orifice OF constantly changes. The overall arrangement is as if the suction orifice itself were moving back and forth in the sub-chamber AK.

In the embodiment of FIG. 3 and 4 oscillatory movement of the band BD is controlled in the same manner as was oscillatory of the bank BD is controlled in the same manner as was oscillatory movement of the cable SE of FIGS. 1 and 2. That is, switches S1 and S2 positioned exterior of the chamber AK adjacent the ends thereof are activated by a magnet DM on the span of the belt exterior of the chamber. The switches are again connected to control circuit ST for the motor M.

It is to be understood that when the terms "sub-chamber" or "stripper chamber" are used herein, that the chamber can be provided by configuring the shroud to provide an area running the length of the shroud into which toner particles will be flung by the brush under the influence of the doctor blade. In the embodiment of FIGS. 1 and 2, the sub-chamber can be considered as that portion of the shroud which the pusher SH moves through. Two orifice openings OF are provided to that portion of the shroud. In the embodiment of FIGS. 3 and 4, the sub-chamber can be considered as the extension of the shroud in which the band BD acts to divide the sub-chamber into a toner receipt area above the band and into a suction area below the band with the suction area below the band having a central orifice OF which, however, communicates to the toner receipt area above the band only through the moving orifice DO.

Figure 5:
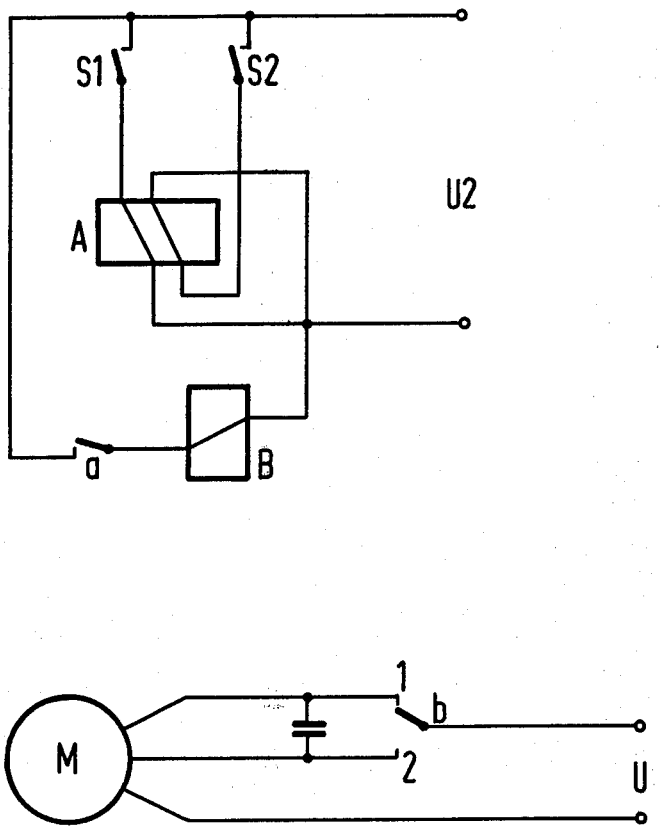
FIG. 5 is an electrical schematic representation of a motor control system for the oscillating portions of this invention.

A simple circuit for the control circuit ST is illustrated in FIG. 5. The motor M is connected to a voltage source U, for example 220 volts AC, through one direct wire and through one of two second wires which are activated by switch b. The switch b can be moved back and forth between wires 1 and 2. The motor is such that if the switch is in the position 1 the motor M rotates in one direction while if the switch is in the position 2 the motor M operates in the opposite direction.

The switch b is activated by means of a motor contact B. The contact B is connected through a switch a to second voltage source U2 which may, for example be 24 volts DC. Relay A has two stable states and controls functioning of the motor contact B. The coils of relay A are connected on the one hand through switch S1 in one direction of the voltage source U2 and on the other hand, through switch S2 in the opposite direction of the voltage source U2. Depending upon whether the switch S1 or S2 is closed, and therefore dependent upon the position of the magnet DM, the switch a will either be closed or open by the relay A so that current will either flow or will not flow to the motor contact B which in turn will either place the switch b in position 1 or in position 2. Placement of the switch b determines direction of rotation of the motor M.

A cleaning device according to either of the forms of this invention has the advantage that toner residue removal from the cleaning device is accomplished by a locally intensified airflow rather than by a high performance suction device capable of providing a sufficiently strong airflow over the entire length of the brush. The ability to use a locally intensified airflow is made possible by means of an oscillating member which, on the one hand, pushes toner to the airflow and, on the other hand, moves the locally intensified airflow within the shroud.

Although the teachings of my invention have herein been discussed with reference to specific theories and embodiments, it is to be understood that these are by way of illustration only and that others may wish to utilize my invention in different designs or applications.

I claim as my invention:

1. A cleaning device for removing toner residue from an intermediate carrier in an electrostatic copier which comprises a rotary bristled brush contacting the intermediate carrier and effective to remove toner residues therefrom, a shroud surrounding the brush extending the length of the brush, the shroud having a sub-chamber area positioned with respect to the brush such that toner residue whirled away from the brush is directed to the sub-chamber area, the sub-chamber area having at least one suction orifice open thereto having a dimension substantially less than the sub-chamber area, a suction device connected to the orifice whereby a locally intensified airflow is provided at the orifice opening to the suction chamber, toner withdrawl means received within said sub-chamber, the toner withdrawl means oscillating within the sub-chamber.

2. The device according to claim 1 wherein two suction orifices are provided, each of which is positioned adjacent an end of the sub-chamber, the ends of the sub-chamber being adjacent axial ends of the brush, the orifices spaced from one another, the toner withdrawl means including a pusher member received within the sub-chamber, the pusher member oscillating between the orifices and effective to push toner residue from between the orifices to the orifices, each of the orifices being connected to the suction device and each orifice providing a localized area of increased airflow.

3. The device of claim 2 wherein the pusher member is attached to a cable means which passes between at least two spaced apart rollers, one of said rollers being driven by a motor.

4. A device according to claim 3 wherein switches are positioned adjacent longitudinal ends of the sub-chamber and the cable has a reach between the rollers extending between the switches, the cable having an actuator mounted thereon for actuating the switches, the switches effective to control the motor to cause oscillation of the band.

5. The device according to claim 4 wherein the switches are reed switches and the actuator is a permanent magnet.

6. A device according to claim 1 wherein the oscillating toner withdrawal means oscillates an orifice opening means back and forth within the sub-chamber.

7. A device according to claim 4 wherein a band is positioned within the sub-chamber forming a dividing wall of the sub-chamber, the orifice opening means comprising an opening through the band having a dimension less than the length of the sub-chamber, and band running the length of the sub-chamber and oscillating back and forth within the sub-chamber to move the opening back and forth within the sub-chamber, and a suction orifice open to the sub-chamber below the band on a side of the band opposite a toner receiving side whereby airflow from the toner receiving side of the band to the suction device is first through the opening in the band and then through the orifice opening.

8. The device according to claim 7 wherein the band passes between at least two rollers, the rollers positioned exterior of the sub-chamber, one of the rollers being motor driven.

9. The device according to claim 8 wherein switches are positioned adjacent longitudinal ends of the sub-chamber and the band has a span between the rollers extending between the switches, the band having an actuator mounted thereon for actuating the switches, the switches effective to control the motor to cause oscillation of the band.

10. The device according to claim 9 wherein the switches are reed switches and the actuator is a permanent magnet.

11. A cleaning device for a rotating drum intermediate carrier of an electrostatic copier which comprises: a rotating bristled brush positioned axis parallel to the drum having bristles contacting the drum along the length of the drum, a shroud received around the brush enclosing the brush except at the periphery of the drum, a sub-chamber within said shroud, a doctor blade within said shroud contacting bristles of said brush and effective to cause said bristles to fling adhering toner particles from the said brush into the said sub-chamber, a suction device, at least one orifice in the sub-chamber operatively connected with the suction device to cause an airflow from the sub-chamber through the orifice, the orifice dimensioned to create an increased rate airflow locally within the sub-chamber at the orifice and oscillating means within the sub-chamber cooperating with the orifice to direct toner particles within the sub-chamber to the orifice.

12. The device of claim 11 wherein orifices are provided adjacent each end of the sub-chamber and the oscillating means includes a moving pusher effective to push toner from intermediate the orifices to the orifices, each of said orifices having an increased airflow with respect to the airflow in remaining areas of the sub-chamber.

13. A device for cleaning rotating drum intermediate carriers in electrostatic copiers which comprises: a rotating bristled brush positioned axis parallel to the drum with the bristles thereof contacting the periphery of the drum, a shroud enclosing the brush except at the periphery of the drum, a sub-chamber within said shroud adjacent said periphery, a doctor blade within said shroud contacting bristles of said brush adjacent said sub-chamber and effective to cause toner particles adhering to said bristles to be flung into said sub-chamber, the sub-chamber having orifice openings adjacent either logitudinal end thereof connected to a suction system, the orifices spaced from one another, an oscillating pusher within said sub-chamber effective to push toner from intermediate areas of said sub-chamber to the said orifices, and motor means causing oscillation movement of the pusher logitudinally of the sub-chamber.

14. A cleaning device for rotary drum intermediate carrier electrostatic copiers comprising: a rotary bristled brush positioned axis parallel to the drum having bristles contacting the drum surface, a shroud enclosing the brush except at the periphery of the drum, means dividing the shroud into a sub-chamber for collection of toner particles flung from said brush into said sub-chamber, the means dividing including an oscillating band dividing the sub-chamber, the band having an orifice opening therethrough, means supplying suction to a side of the band opposite the brush whereby an increased flow air jet is provided at the orifice, and means oscillating the orifice longitudinally of the sub-chamber.

15. The device of claim 14 wherein the band constitutes an endless band having the orifice formed therein, the band received around rolls with a reach of the band between the rolls extending longitudinally of the shroud interior thereof to divide the shroud, one of said rolls being rotated by a motor.

16. The device of claim 15 including motor control means causing reversal of the motor to oscillate the orifice opening longitudinally of the sub-chamber, the motor control means including switches positioned adjacent longitudinal ends of the sub-chamber and a switch activator carried by said band.

17. The device of claim 16 wherein a second reach of the band from roll to roll is positioned exterior of the sub-chamber and the switches and switch activator are positioned exterior of the sub-chamber, the switch activator being positioned on the second reach.

18. A cleaning device for removing toner residue from the intermediate carrier of an electrostatic copier comprising a rotary bristled brush contacting the intermediate carrier and effective to remove toner residue therefrom, a shroud substantially enclosing the brush except at the area of contact with the intermediate carrier, a suction device in communication with the shroud at at least one fixed location orifice, oscillating means within the shroud for directing toner to the orifice, and means moving the oscillating means back and forth within the shroud axially of the brush.

19. The device of claim 18 wherein the oscillating means is a pusher and two fixed orifices are provided adjacent either longitudinal end of the shroud, the pusher oscillated back and forth between the orifices.

20. The device of claim 18 wherein the oscillating means is a belt member bisecting the shroud, the fixed orifice is open to a chamber below the belt, the brush is positioned above the belt, and the belt has an opening therethrough substantially less than the longitudinal length of the shroud, the opening being moved back and forth longitudinally of the shroud by an oscillation of the belt, airflow from the orifice to the shroud area around the brush being substantially through the opening.

* * * * *